US005305566A

United States Patent [19]

Larkowski

[11] Patent Number: 5,305,566

[45] Date of Patent: Apr. 26, 1994

[54] MOLDING SYSTEM FOR REPLACEMENT DOORS AND WINDOWS

[76] Inventor: Brian J. Larkowski, 1952 Stanley Ave., Signal Hill, Calif. 90806

[21] Appl. No.: 85,913

[22] Filed: Jul. 6, 1993

[51] Int. Cl.[5] ..... E06B 1/04

[52] U.S. Cl. ..... 52/211; 52/212; 52/204.54

[58] Field of Search ..... 49/504; 52/204.53, 204.54, 52/211, 212, 213, 217, 204.55, 204.56

[56] References Cited

U.S. PATENT DOCUMENTS

| | | | |
|---|---|---|---|
| 1,048,988 | 12/1912 | Mayo, Sr. . | |
| 1,150,790 | 8/1915 | Swanson . | |
| 1,929,634 | 10/1933 | Gifford . | |
| 2,562,105 | 7/1951 | Lang . | |
| 2,582,765 | 1/1952 | Brew . | |
| 4,193,238 | 3/1980 | Chalmers et al. | 52/204.53 |
| 5,018,325 | 5/1991 | Gree . | |
| 5,210,987 | 5/1993 | Larkowski | 52/211 |

FOREIGN PATENT DOCUMENTS

| | | | |
|---|---|---|---|
| 2408713 | 7/1979 | France | 52/204.53 |
| 180245 | 5/1962 | Sweden . | |

*Primary Examiner*—Carl D. Friedman

*Assistant Examiner*—Kevin D. Wilkens

*Attorney, Agent, or Firm*—Richard C. Litman

[57] ABSTRACT

A molding system for use in the replacement of articles, such as doors and windows. More specifically, the molding system is for use in the replacement of windows and door in stucco buildings. A method is disclosed for installing the molding which includes making a uniformed cut about the periphery of the article being replaced, removing the outermost surface of the supporting structure defined between the uniformed cut and the periphery of the article being replaced, replacing the existing article with a replacement article, and installing the molding system around the perimeter of the replacement article. The molding system comprises a first member which is fastenable about the periphery of an article and which includes a tab that is engagable with a second member. The second member has a first return engagable with the tab of the first member and a second return engagable with a groove around the perimeter of the replacement article. The second member bridges across and conceals the joint between the article and the supporting structure associated therewith. Alternatively, the molding is precut and integral with the replacement article.

10 Claims, 6 Drawing Sheets

MOLDING SYSTEM FOR REPLACEMENT DOORS AND WINDOWS

BACKGROUND OF THE INVENTION

1. Field of the Invention

The present invention relates to a molding system for replacement of doors and windows and, more specifically, to a molding system for use in installing replacement doors and windows in stucco structures.

2. Description of the Prior Art

Typically, conventional methods for replacing windows and doors in stucco structures first encompasses the removal of the stucco surface about the perimeter of the windows and door being replaced. In my recently issued patent, U.S. Pat. No. 5,210,987 issued May 18, 1993, a method was disclosed for limiting the quantity of stucco being removed about the perimeter of the windows and doors being replaced. Further, a casing was introduced which would conceal the area from which the stucco was removed and virtually eliminate patching and repair altogether.

Window and door casings are well known in the prior art. In fact, U.S. Pat. No. 1,048,988, issued Dec. 31, 1912 to Robert D. Mayo, Sr., discloses a sheet metal casing for doors, windows and the like. The casing is vertically and horizontally adjustable within an opening in the wall. The casing includes an inner casing, an outer casing, and a stop. The outer casing is slidably engagable with the inner casing.

A door trim is disclosed in U.S. Pat. No. 1,150,790, issued Aug. 17, 1915 to Charles J. Swanson. The door trim is of a sheet metal material and a means for attaching the same to the jambs and lintel about the opening of a door is included. Holding clips are fastened about the opening and the trim is sprung into place upon the clips.

A frame construction for building openings is disclosed in U.S. Pat. No. 1,929,634, issued Oct. 10, 1933 to Charles P. Gifford who teaches of a trim including an inwardly extending flange which seats against the blocking of the window and is secured to this blocking by a wood facing and a suitable attaching means. Once the window is set, plastering is done and the trim is embedded in the plaster.

Another casing is disclosed in U.S. Pat. No. 2,562,105, issued Jul. 24, 1951 to Wilbur L. Lang. Lang shows a door casing made from extruded plastics and other materials. The casing includes inner and outer elongated corrugated members each having two integral longitudinal sections disposed at right angles to each other. One of the two longitudinal sections is tapered for insertion between the plaster and the stud. Inner and outer casing members are joined together by an integral stop.

A trim used in buildings, such as door and window casings and, more particularly, a metal trim for doors and windows is disclosed in U.S. Pat. No. 2,582,765, issued Jan. 15, 1952 to Lewis J. Brew. The trim includes reinforcing members engagable with two side pieces and a door stop for adjoining the two side pieces.

A system and method of shielding the periphery of a framework of a building opening adjacent a building surface is disclosed in U.S. Pat. No. 5,018,325, issued May 28, 1991 to Oliver Geen et al. The system consists of a first elongated member associated with the article occupying the opening and a second elongated member associated with the building surface. Each elongated member has an elongated channel. An angular facia member communicates with both the first and second elongated members. The angular facia member is slidably insertable into each of the channels.

Swedish Patent No. 180,024 issued May 3, 1962 to M. R. Jönsson discloses a device for concealing a joint between a wall and a frame. The device is comprised of a sheet having a U-shaped cross-section. One branch of the U-shaped member passes into a groove in the frame and includes a hook which is bent in a direction toward the frame to frictionally engage with the frame. The other branch of the U-shaped member, under resilience, braces against the wall.

None of the above patents, taken either singly or in combination, is seen to describe the instant invention as claimed.

SUMMARY OF THE INVENTION

The present invention relates to a molding system for use in the replacement of doors and windows and a method for using the same. More specifically, the present invention relates to a molding system for use in the replacement of windows and doors in stucco buildings. The method includes the steps of: making a uniformed cut through the stucco surface about the periphery of the door or window being replaced; removing the outermost stucco surface defined between the uniformed cut and the periphery of the door and window; replacing the door or window; and installing the molding system around the perimeter of the replacement door or window. The molding system comprises two members, a first member fastenable about the periphery of the replacement door or window and a second hingedly engaging the first member. The second member has return engagable with a tab engagable with a groove around the perimeter of the door or window. The second member bridges across and conceals the area from which the stucco was removed. Alternatively, the molding system is precut and integral with the replacement window.

Accordingly, it is a principal object of the invention to provide a molding system for use in replacing windows and doors in a stucco structures that will virtually eliminate repair of the stucco surface.

Another object is that the molding system include a first member fastenable within the area from which stucco was removed and a second member hingedly attached to and matingly engageable with the first member so as to conceal the first member in the area in which stucco was removed.

Yet another object is that the molding system be precut and integral with the replacement window.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
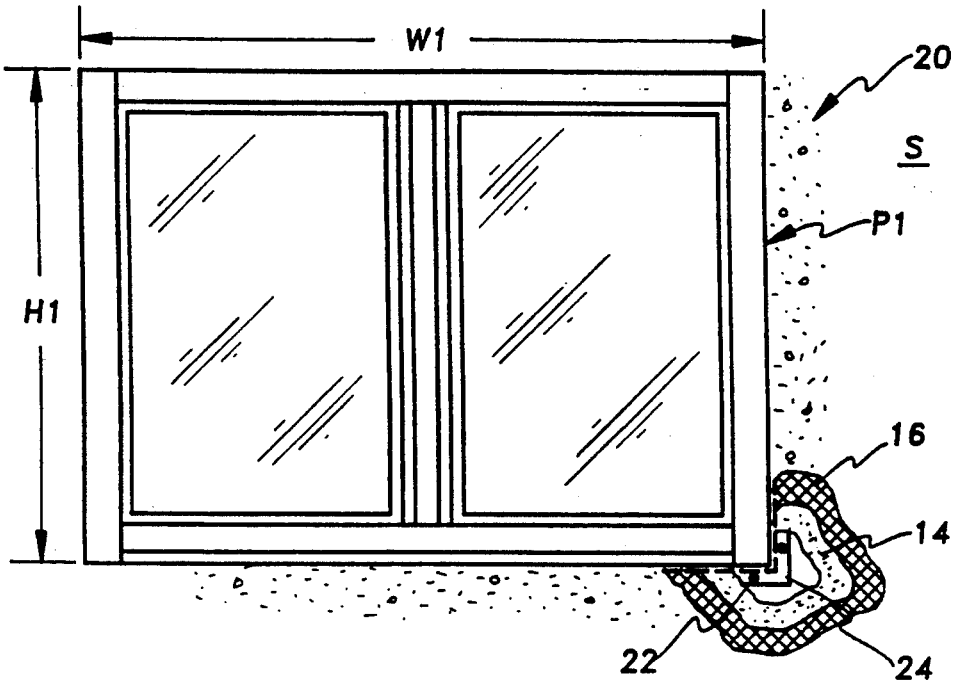
FIG. 1 is a front elevational view of an existing window in a supporting structure and a partial broken view of the supporting structure showing the various layers of subsurface.
Figure 2:
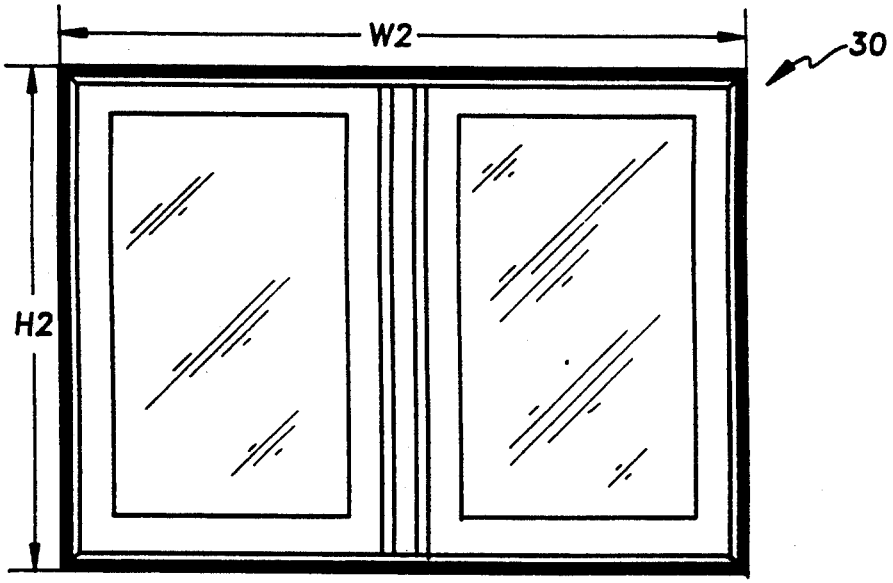
FIG. 2 is a front elevational view of a replacement window.
Figure 3:
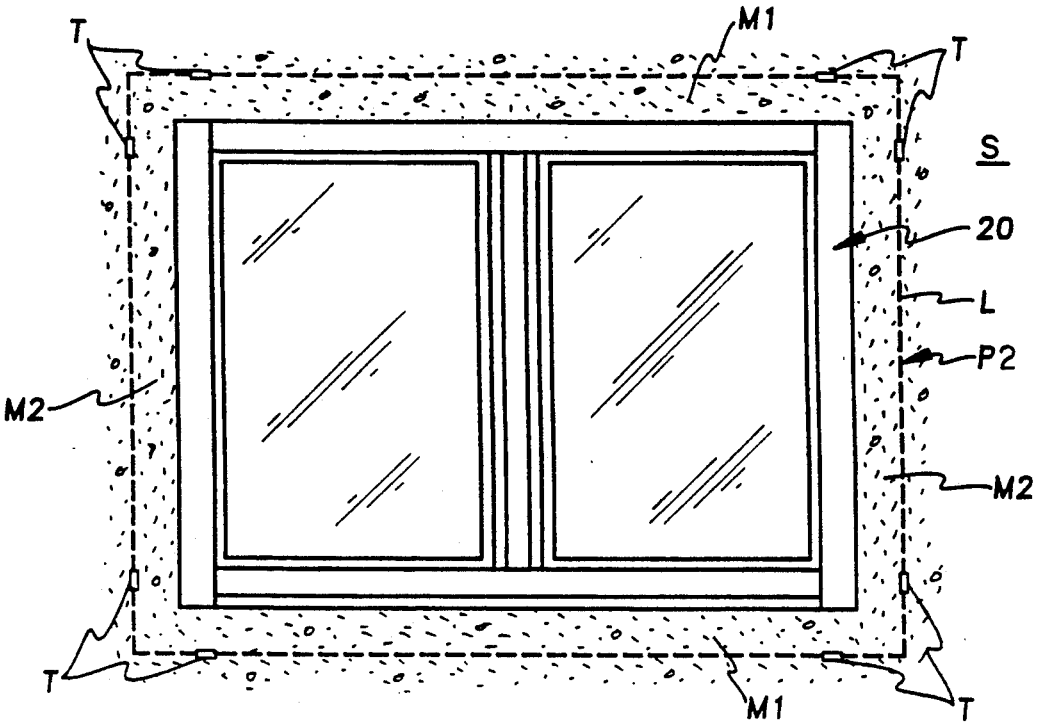
FIG. 3 is a front elevational view of the existing window in the supporting structure with a margin of stucco defined between the existing window and a chalk line.
Figure 4:
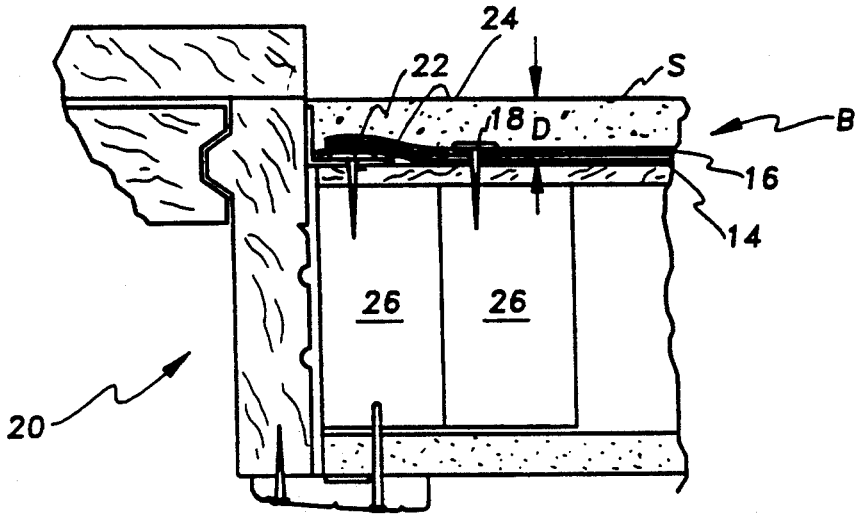
FIG. 4 is a cross-sectional view of the existing window in the supporting structure prior to cutting the stucco surface along the chalk line.
Figure 5:
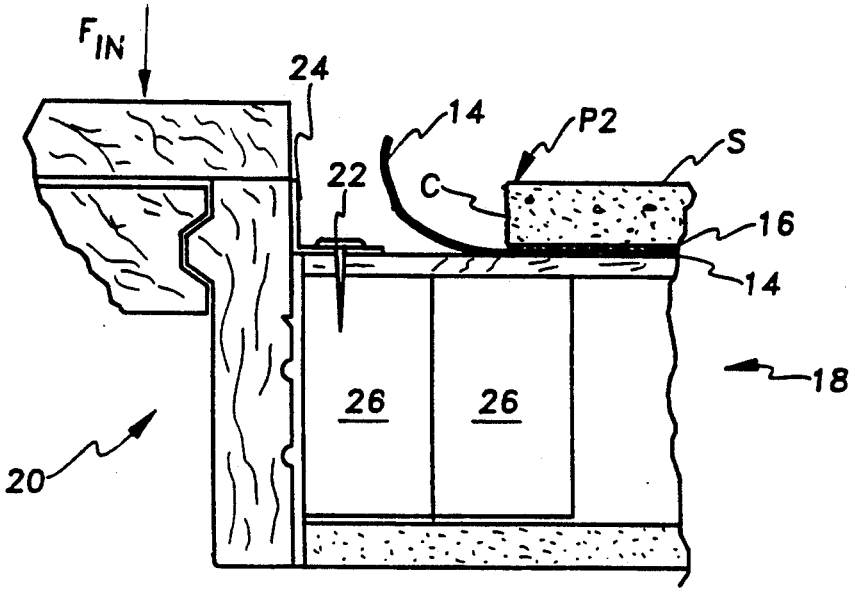
FIG. 5 is a cross-sectional view of the existing window in the supporting structure after to cutting the stucco surface along the chalk line.

The present invention relates to a molding system for use in replacing doors and windows in stucco buildings. Referring to FIGS. 1 through 3, determine the height H1 and width W1 of the door or window 20 being removed. Next, determine the height H2 and width W2 of replacement door or window 30. Now, determine the margin M1, M2 of stucco to be removed about the existing perimeter P1 of the existing window 20. This is accomplished by solving for the difference Δ H between the heights H2 and H1 as well as the difference Δ W between the widths W2 and W1 and multiplying these differences Δ H, Δ W by one-half, thus producing values which correspond to the margin M1 of stucco ½ Δ H to be removed along both the top and bottom edges of the existing window 20 as well as the margin M2 of stucco ½ Δ W to be removed along both the left and right sides of the existing window 20. Mark the stucco surface S about the periphery P1 of the existing window 20. This may be performed in a conventional manner, such as inscribing tick marks T and popping a chalk line L along the tick marks T. Hence, a new periphery P2 (shown in FIG. 3) has been established, one which will accept the replacement window 30 being installed.

The determination of a new perimeter about an opening may vary depending on the configuration of the opening. For example, whether the opening may be arcuate, circular, elliptical, et cetera. The opening illustrated was chosen for simplification of this description.

Now, referring to FIGS. 3 through 6, after the new periphery P2 has been marked, cut through the stucco surface S along the chalk line L. This step may be performed with the aid of worm drive saw having a diamond or abrasive blade (not shown). The structure or building B associated with the existing window 20 should be sealed so as to prevent any dust created through the cutting of this stucco surface S from entering the interior of the building B. The depth of the cut C should be slightly less that of the thickness of the stucco surface S. Preferably, the integrity of the underlayment 14, that is, the underlying asphalt impregnated felt paper, should not be compromised. Typically, standard stucco thickness ranges between seven eighths of an inch to one inch. Cutting the stucco at a depth D of three quarters of an inch could reduce and possibly eliminate the disfigurement the felt paper 14. Flashing paper and caulking (not shown) can be used, if necessary, to repair areas of damage to the underlayment 14.

The margin M1, M2 of stucco surface S defined within the new periphery P2 is now removed. This task could be completed through the use of a small cold chisel (not shown), holding the chisel centrally in the margin M1, M2 against the stucco surface S. The chisel should be held at an angle 45 degrees relative to the stucco surface S. In most circumstances, this margin M1, M2 of stucco surface S cleanly separates form the underlying wire or mesh lathing 16. Occasionally, it may be necessary to cut the lathing 16 which secures the stucco surface S along the periphery of the cut C, and thus, prevent any unnecessary damage to the stucco surface S outside of the margin M1, M2 and beyond the area which the molding system 100 will cover. Wire nippers (not shown) may facilitate in cutting the lathing 16. If during this removal step the stucco surface S becomes damaged beyond the area in which the molding system 100 (shown in FIG. 10) will cover, the damaged area may easily be repaired with proper color coating or through patching the damaged area and painting the patched damaged area with matching masonry paint.

After the necessary margin M1, M2 of stucco surface S has been removed, the remaining lathing 16 is cut with the wire nippers as closely to the cut C or the new periphery P2 as possible. All of the lathing nails 18 are removed from the margin M1, M2 as well This renders a clean cut condition within the margin M1, M2 which maximizes the removal of the existing window 20 as well as the quality of impending installation of the replacement window 30 in regards to vapor barrier, durability, and aesthetic appearance.

Once the aforementioned steps have been completed, a thorough clean up of the exterior of the building B is conducted. This reduces the risk of any dust or debris (created in the foregoing steps) from entering into the building B, thus lessening the amount of interior clean up.

Figure 6:
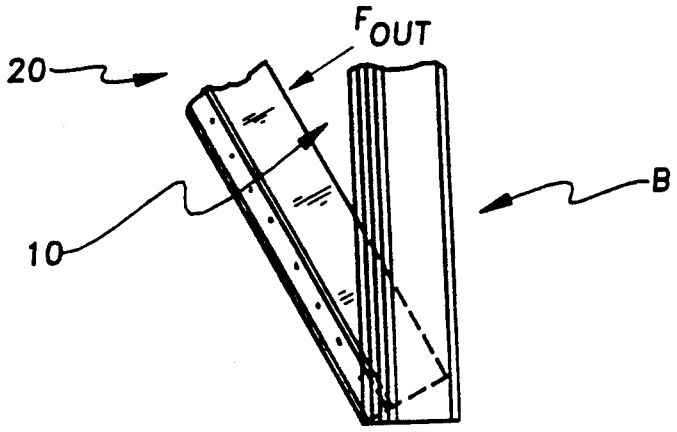
FIG. 6 is a side elevational view of the existing window being pivotally removed from the supporting structure.

Next, remove the fasteners 22 from the mounting flange 24 or nail on fin which secures the existing window 20 to the surrounding framing members 26. It may be necessary to lift the flashing paper 14 about the sides and top of the existing window 20 in order to gain access to fasteners 22 therebehind. Just prior to removing the last fastener from the mounting flange 24, apply a slight inward force $F_{IN}$ against the existing window 20 to ensure that the same does not fall forward out of the opening 10, as is shown in FIG. 6. When the last fastener 22 is removed and with the existing window 20 being supported from the exterior of the building B, the top of the existing window 20 may freely fall forward out of the opening 10, pivoting on the bottom thereof. The bottom may now be lifted and completely removed from the opening 10. If necessary, a gentle outward force $F_{OUT}$ may need to be exerted against a top interior portion of the existing window 20 to urge the same outward. This type of pivotal or "hinge-type" removal may reduce the risk of injury.

Once the existing window 20 has been removed, the replacement window 30 may be installed. Measure the cross-section of the opening 10. Compare these measurements with those required by the manufacturer's specifications for the installation of the replacement window 30 (shown in FIGS. 7 through 9). If the opening 10 is too large, shim the opening 10 equally about the periphery P1 until the opening 10 is sized according to the specifications. It is crucial that the opening 10 be shimmed equally about the periphery P1 so as to ensure that the replacement window 30 is centered within the opening 10 when the shimming is completed. It is advisable that the opening 10 be measured once again and that this measurement be compared with the manufacturers specification. Also, measure the replacement window 30 and compare this measurement with the measurement of the opening 10. This will further ensure that the opening 10 has been properly sized.

Figure 7:
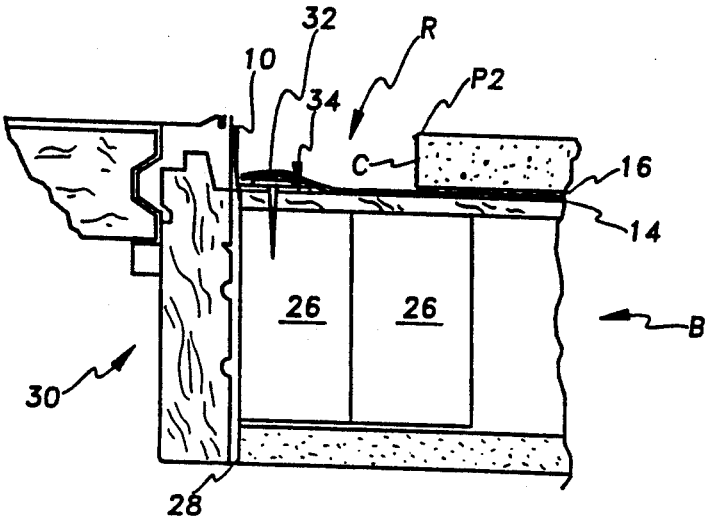
FIG. 7 is a cross-sectional view of the replacement window installed in the supporting structure.
Figure 8:
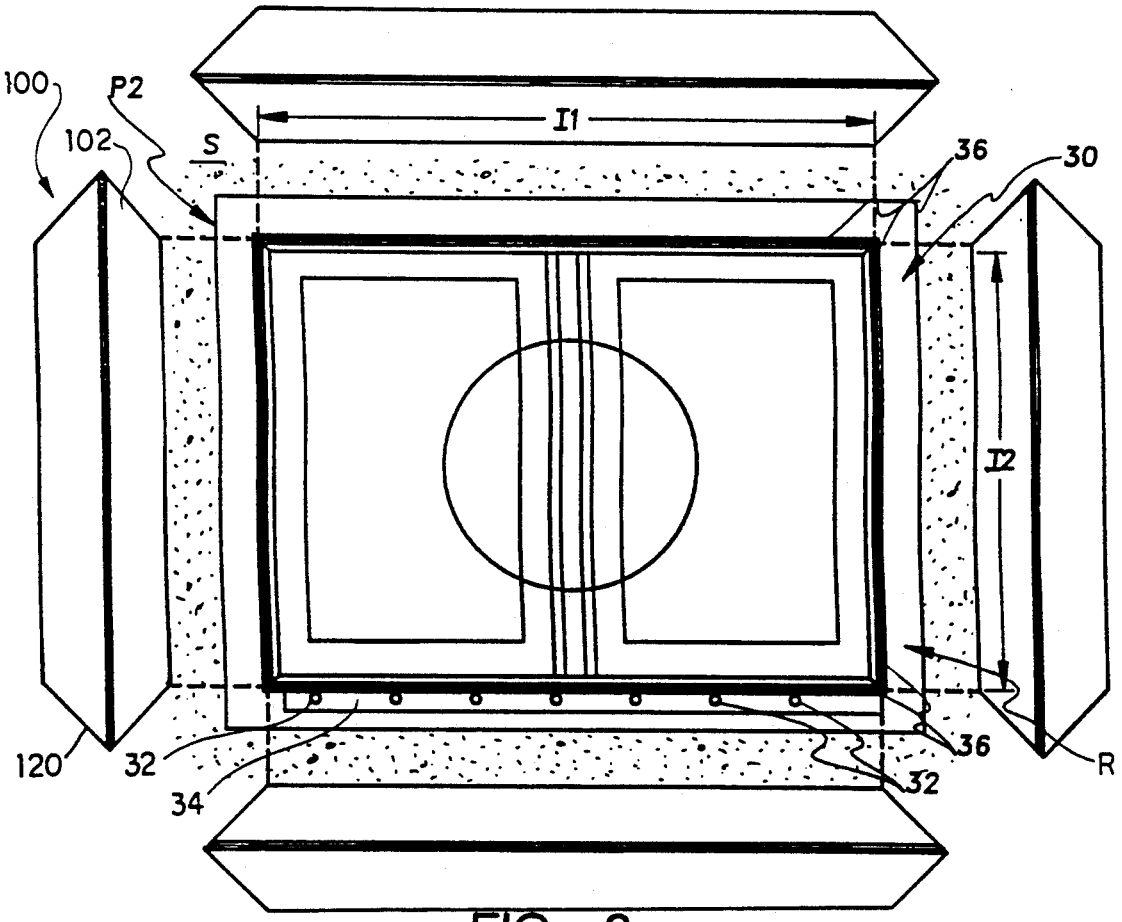
FIG. 8 is a front elevational view showing a proper overlapping of the felt and flange about the perimeter of the replacement window.
Figure 9:
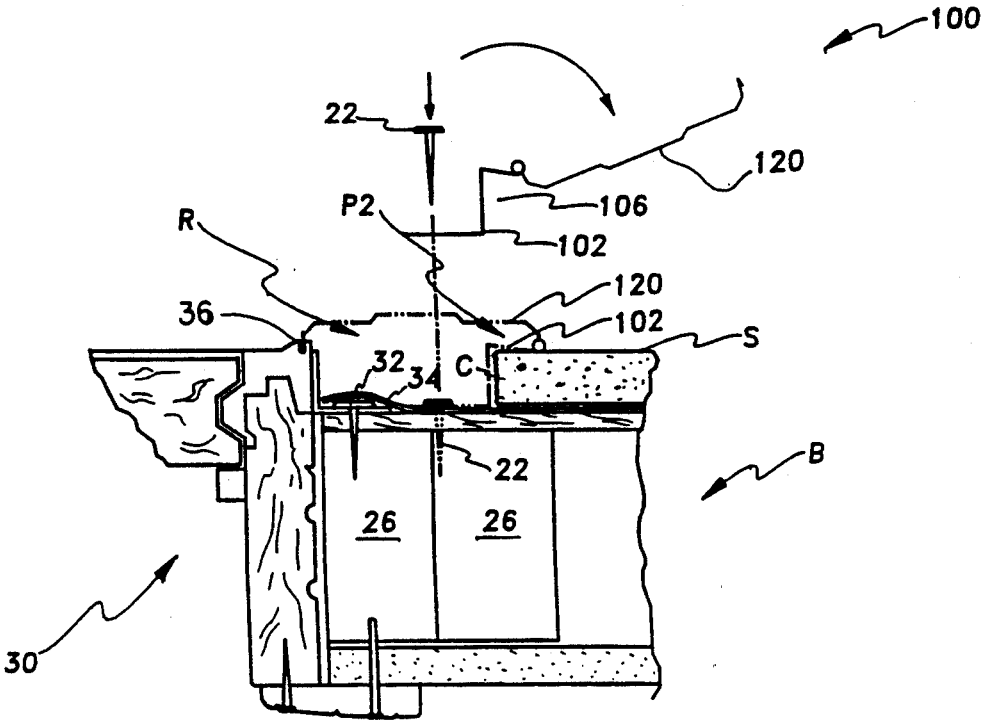
FIG. 9 is a cross-sectional view of the molding system installed about the perimeter of the newly installed replacement window.

Referring to FIGS. 7 through 9, after the opening 10 has been sized, the replacement window 30 can be installed in the opening 10. Caulk the innermost edge of the new mounting flange 34 and set the replacement window 30 in the opening 10. Both the sides and the top of the existing flashing paper 14 should overlap the new mounting flange 34 and the new mounting flange 34 should overlap the existing bottom strip of flashing paper 14 along the bottom of the replacement window 30 (shown in FIG. 8). This overlapping is a conventional practice which prevents penetration of moisture beyond the new mounting flange 34. The caulking of the innermost edge of the mounting flange 34 further prevents penetration of moisture beyond the new mounting flange 34.

The replacement window 30 is now checked to ensure that the same is square as well as level and plumb in the opening 10. More shimming about the opening 10, such as with shim 28, may be necessary to properly center the replacement window 30 therein. This guarantees the long lasting functional and aesthetic qualities of the replacement window 30. At this point, the replacement window 30 is secured in place, preferably with corrosion resistant (i.e. galvanized) fasteners 32 to the underlying or surrounding framing members 26.

Determine the dimensions and the desired mounting locations of the molding system 100. To determine the necessary dimensions for the molding system 100, first measure from the exterior molding receptor groove 36 located along one edge of the replacement window 30 to the exterior molding receptor groove 36 on an opposite edge of the replacement window 30. This will provide the interior lengths I1,I2 of the peripheral molding 120 (shown in FIG. 8). Cutting opposite ends of each piece of the molding system 100 at an angle of 45 degrees will ensure a continuous engagement of the molding system 100 about the perimeter of the replacement window 30 and a solid engagement of the peripheral molding 120 with the receptor groove 36. After cutting the molding system 100, apply a generous and uninterrupted bead of adhesive caulk 106 along the entire length of each angular stress retention clip 102. The caulk 106 is applied on the surface of the angular stress retention clip 102 which abuts the cut C or the new periphery P2 the stucco surface S. The angular stress retention clips 102 are each then pressed into position within the recess R about the perimeter of the replacement window 30. The innermost edge 108 of each angular stress retention clip 102 overlaps the previously secured new mounting flange 34 of the replacement window 30. The molding system 100 is secured along the top, the bottom, and the two sides of the replacement window 30. Corrosion resistant fasteners 22 are used to secure the angular stress retention clips 102 place and, in turn, retain the molding system 100 about the replacement window 30. The angular stress retention clips 102 are secured to the existing underlying framing members 26 surrounding the replacement window 30.

After the molding system 100 is secured about the periphery of the replacement window 30, the peripheral molding 120 is pivotally closed to conceal the angular stress retention clips 102 and the return 124 located opposite the hinged end of the peripheral molding 120 is engaged with the receptor groove 36 located about the perimeter of the replacement window 30. It may be necessary to gently tap the protrusion 134 of the peripheral molding 120 into the receptor groove 36, such as with a rubber mallet (not shown). This completes the installation of the replacement window 30.

Figure 10:
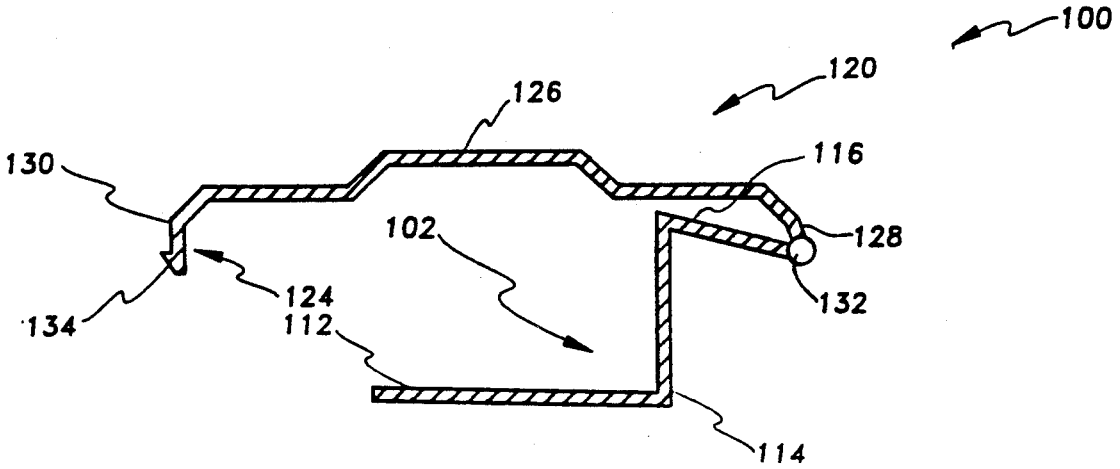
FIG. 10 is a cross-sectional view of the molding system.

FIG. 10 shows the molding system 100 being comprised of two parts, an angular stress retention clip 102 and a peripheral molding 120 hingedly attached to the angular stress clip 102. The peripheral molding 120 is comprised of an elongated substantially U-shaped member having a first substantially planar surface 126. The first surface 126 has a second surface 128 attached at one end and a third surface 130 at an opposite end. Each of these surfaces 128, 130 are attached at substantially right angles relative to the first surface 126. The second surface 128 has a first hinge element 132 attached thereto. The first hinge element 132 is engagable with the angular stress retention clip 102. The third surface 130 has a protrusion 134 in a direction away from the second surface 128. The protrusion 134 in combination with the third surface 130 form a second return 124 which is frictionally engagable with a receptor groove 36 located around the perimeter of the replacement window 30. When the peripheral molding 120 is installed about a window 30, the joint between the window 30 and the supporting surface is concealed.

The angular stress retention clip 102 is an elongated substantially Z-shaped member having a first substantially planar surface 112 integral with a second substantially planar surface 114, these surfaces 112, 114 being disposed at an angle A of 90 degrees relative to one another. These two surfaces 112, 114 are fastened in a recess R about the perimeter of the replacement window 30 such that the first surface 112 contacts the flashing 14 and overlaps the new flange 34 and the second surface 114 contacts the cut edge C of the surface S of the supporting structure B. A third substantially planar surface 116 is integral with the second surface. These two surfaces 114, 116 are disposed at an angle B less than 90 degrees relative two one another and opposite to angle A. This configuration creates a tension force $F_T$ between the third surface 116 and the surface S of the supporting structure B attached thereto. A second hinge element 110 is provided at an end of the third surface 116 opposite the end integral with the second surface 114. The first hinge element 132 of the peripheral molding 120 is meshingly engaged with the second hinge element 110 of the angular stress retention clip 102. The tension force $F_T$ holds the angular stress retention clip 102 tightly against the surface S of the supporting structure B, thus insuring a weather resistant installation of the replacement window 30.

Figure 11:
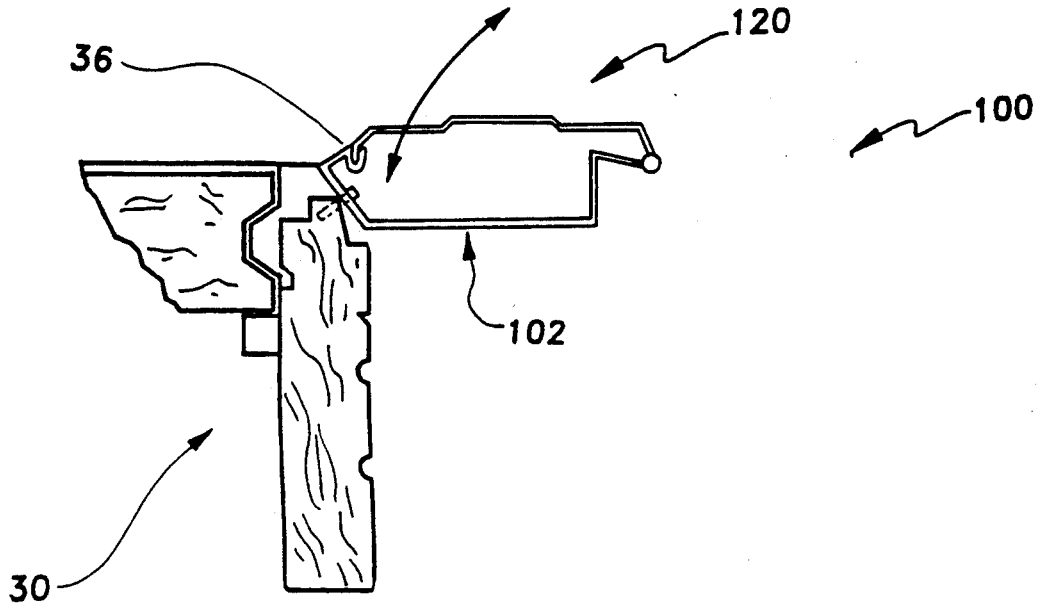
FIG. 11 is a cross-sectional view of the molding system integral with a replacement window.

Alternatively, the angular stress retention clip 102 is integral with the replacement window 30, thus forming the mounting flange 34, as shown in FIG. 11. It should be noted that the height H2 and the width W2 of the replacement window 30 in this case should be measured along the second substantially planar surfaces 114 of the mounting flanges 34 and not along the hinges 110 of the mounting flanges 34 (see FIG. 10).

It is to be understood that the present invention is not limited to the embodiments described above, but encompasses any and all embodiments within the scope of the following claims.

I claim:

1. A molding system for use about the periphery of an article, the article being attached to and disposed within an opening in a supporting structure, said molding system comprising:

a) a first member; and b) a second member hingedly attached to said first member, said second member having means for engaging the periphery of the article, whereby said first member is fastenable about the periphery of the article and said second member is hingedly displaceable to cover the first member and to engage the periphery of the article.

2. The molding system according to claim 1, wherein said first member has a substantially Z-shaped configuration having opposite ends, a first of said ends being insertable within a recess about the periphery of the article and said second member being hingedly attached along a second one of said ends.

3. The molding system according to claim 1, wherein said second member has substantially U-shaped configuration with said engaging means being located along a first end of said U-shaped configuration and said first member being hingedly attached along a second end of said U-shaped member.

4. The molding system according to claim 1, wherein the article includes a groove therein and said engaging means comprises a return engagable with the groove in the article.

5. The molding system according to claim 4, wherein said return frictionally engages said groove.

6. An article casing for an article being attached to and disposed within an opening in a supporting structure, said article casing comprising:

a) an encasement defining a periphery of said article; and b) a molding system integral with said encasement, said molding system comprising:

1) a first member extending from said encasement, and 2) a second member hingedly attached to said first member, said second member having means for engaging said encasement, whereby said second member is hingedly displaceable to cover the first member and to engage said encasement.

7. The molding system according to claim 6, wherein said first member has a substantially Z-shaped configuration having opposite ends, a first of said ends being insertable within a recess about the periphery of the article and said second member being hingedly attached along a second one of said ends.

8. The molding system according to claim 6, wherein said second member has substantially U-shaped configuration with said engaging means being located along a first end of said U-shaped configuration and said first member being hingedly attached along a second end of said U-shaped member.

9. The molding system according to claim 6, wherein said encasement includes a groove therein and said engaging means comprises a return engagable with the groove in said encasement.

10. The molding system according to claim 9, wherein said return frictionally engages said groove.

* * * * *